US010801319B2

(12) United States Patent
Harrison et al.

(10) Patent No.: US 10,801,319 B2
(45) Date of Patent: Oct. 13, 2020

(54) SENSING OF THE CONTENTS OF A BORE

(71) Applicant: Salunda Limited, Oxfordshire (GB)

(72) Inventors: Martin Roy Harrison, Oxfordshire (GB); Philip Samuel Pickles, Oxfordshire (GB); Alan Patrick John Finlay, Herefordshire (GB)

(73) Assignee: Salunda Limited, Oxfordshire (GB)

( * ) Notice: Subject to any disclaimer, the term of this patent is extended or adjusted under 35 U.S.C. 154(b) by 276 days.

(21) Appl. No.: 15/569,965

(22) PCT Filed: Apr. 28, 2016

(86) PCT No.: PCT/GB2016/051208

§ 371 (c)(1),
(2) Date: Oct. 27, 2017

(87) PCT Pub. No.: WO2016/174439

PCT Pub. Date: Nov. 3, 2016

(65) Prior Publication Data

US 2018/0156029 A1 Jun. 7, 2018

(30) Foreign Application Priority Data

Apr. 30, 2015 (GB) ..... 1507434.7
Oct. 8, 2015 (GB) ..... 1517818.9

(51) Int. Cl.
*E21B 47/09* (2012.01)
*E21B 47/092* (2012.01)
*E21B 33/06* (2006.01)

(52) U.S. Cl.
CPC ..... *E21B 47/092* (2020.05); *E21B 33/063* (2013.01)

(58) Field of Classification Search
CPC .. E21B 47/0905; E21B 47/092; E21B 33/063; E21B 47/09

(Continued)

(56) References Cited

U.S. PATENT DOCUMENTS 3,103,976 A 9/1963 De Vries et al.
3,843,923 A 10/1974 deVries et al.
(Continued)

FOREIGN PATENT DOCUMENTS

GB 2490685 A 11/2012
WO 2003050390 A1 6/2003
(Continued)

OTHER PUBLICATIONS

Andarawis, Intelligent BOP RAM Actuation Sensor System Presentation, RPSEA, Jun. 4, 2014.
(Continued)

*Primary Examiner* — Farhana A Hoque
*Assistant Examiner* — Courtney G McDonnough
(74) *Attorney, Agent, or Firm* — Honigman LLP

(57) ABSTRACT

An elongate component such as a drill string of drill pipes connected by joint sections inside a bore is sensed using at least one set of electromagnetic coils, the coils within the set being arranged at different angular positions around the bore facing the bore. There may be at least two sets of coils separated along the axial direction of the bore. Electrical oscillations are generated in the coils to produce oscillating electromagnetic fields that interact with the contents of the bore. A parameter of the electrical oscillations generated in each coil is detected. The detected parameters may be used to derive both (1) a measure of the axial position along the bore, and (2) a measure of the lateral position. The detected parameters may be used to derive a measure of electromagnetic properties of the contents of the pipe in a region adjacent each coil, thereby imaging the contents of the pipe.

29 Claims, 5 Drawing Sheets

(58) Field of Classification Search
USPC ..... 324/207.16, 220–221, 346
See application file for complete search history.

(56) References Cited

U.S. PATENT DOCUMENTS

| | | | | |
|---|---|---|---|---|
| 7,274,989 | B2 | 9/2007 | Hopper | |
| 8,035,374 | B1 | 10/2011 | Girrell et al. | |
| 9,259,168 | B2 | 2/2016 | Marashdeh et al. | |
| 2003/0122541 | A1* | 7/2003 | Lantto | G01D 5/20 324/207.16 |
| 2004/0263158 | A1* | 12/2004 | Biester | E21B 47/0905 324/207.24 |
| 2007/0057669 | A1* | 3/2007 | Kobayashi | G01R 33/04 324/253 |
| 2009/0039876 | A1 | 2/2009 | Biester et al. | |
| 2010/0079136 | A1* | 4/2010 | Phillips | F01D 11/20 324/207.16 |
| 2010/0097374 | A1 | 4/2010 | Fan et al. | |
| 2013/0002255 | A1 | 1/2013 | Shampine | |
| 2013/0020981 | A1* | 1/2013 | Borchers | G02B 26/105 318/652 |
| 2013/0085365 | A1 | 4/2013 | Marashdeh et al. | |
| 2013/0141117 | A1* | 6/2013 | Nikolenko | G01N 27/028 324/655 |
| 2016/0206227 | A1 | 7/2016 | Marashdeh et al. | |
| 2016/0312603 | A1 | 10/2016 | Gottlieb et al. | |

FOREIGN PATENT DOCUMENTS

| | | | |
|---|---|---|---|
| WO | 2009147385 | A2 | 12/2009 |
| WO | 2012/007718 | A2 | 1/2012 |
| WO | 2012153090 | A2 | 11/2012 |
| WO | 2015/015150 | A1 | 2/2015 |
| WO | WO-2015145130 | A1 | 10/2015 |
| WO | 2016130979 | A1 | 8/2016 |

OTHER PUBLICATIONS

Andarawis, Intelligent BOP RAM Actuation Sensor System Report, RPSEA, Sep. 25, 2014.

* cited by examiner

SENSING OF THE CONTENTS OF A BORE

TECHNICAL FIELD

The present invention relates to sensing of the contents of a bore.

BACKGROUND

In some aspects, the present invention relates to the sensing of an elongate element inside the bore. In oil and gas extraction and production, there are a wide range of situations where it is necessary to sense an elongate element inside a bore. An example of such an elongate element is a drill string of drill pipes connected by joint sections inside a well bore.

In the case of such a drill string, such sensing is useful for controlling a blow-out preventer (BOP). A BOP is used to shut off the flow of oil and gas from a well when the pressure reaches a dangerous level. Shear rams inside the BOP cut through tubulars running into the well, such as the drill string, and seal off the well, preventing uncontrolled releases of oil and gas. The drill string typically comprises a series of drill pipes and a bottom hole assembly (BHA), for example comprising one or more tools. The drill pipes are each typically 10 m long. The drill pipes are connected by thicker joint sections, which typically allow the drill pipes to be screwed together. Joints typically make up approximately ten percent of the length of a drill pipe. To ensure successful operation, the shear rams must cut through the drill pipes of the drill string at a point between the joint sections. If the shear rams attempt to cut through the drill string at a joint section, there is a risk of the greater thickness of the metal at this position preventing the shear rams from successfully shearing the pipe and completely sealing the well. Accordingly, to control the operation of a BOP, and ensure successful well control, it is important to sense the axial position along the bore of joint sections.

Various sensor systems for sensing the axial position along the bore of joint sections are known, many of these dating from the 1960s and 1970s when undersea drilling first became widespread. By way of example, each of U.S. Pat. Nos. 3,103,976, 3,843,923 and 7,274,989 disclose electromagnetic (EM) sensor systems for sensing the axial position of a joint section in a drill string.

In addition, if the drill string is laterally displaced from the axis of the bore and hence the axis of the BOP towards the wall of the bore by an excessive amount in certain directions, then the shear rams may also be ineffective in completely shearing off-center pipe and sealing the well. Thus, there is a clear need for a reliable system that senses the lateral position of an elongate object within the bore. Such sensing is difficult, because it needs to be stable and sensitive enough to cope with the changing conditions inside the bore, for example as caused by large variations in temperature, pressure and fluid composition.

In other aspects, the present invention relates to sensing of the electromagnetic properties of the contents of the bore. In oil and gas extraction and production, there are a wide range of situations where it is advantageous to sense the electromagnetic properties of the contents of the bore, for example as discussed in WO-2012/007718, WO-2015/015150 and GB-2,490,685. Furthermore, WO-2012/153090 describes a fluid conduit fabricated from a composite material that incorporates sensors that sense the properties of the contents of the bore, in particular forming a cavity resonator packaged inside the fluid conduit.

SUMMARY

According to the present invention, there is provided a sensor system for sensing the contents of a bore, the sensor system comprising:

plural electromagnetic coils arranged facing the bore for generating an electromagnetic field directed laterally into the bore;

a drive circuit arrangement arranged to generate electrical oscillations in the coils for producing oscillating electromagnetic fields that interact with the contents of the bore; and a detection circuit arrangement arranged to detect a parameter of the electrical oscillations generated in each coil.

The sensor system may further comprise a processing circuit supplied with the detected parameters and arranged to derive a measure of position of an elongate component in the bore.

The detected parameters may be used to derive a measure of the lateral position of an elongate component.

The coils may include coils at different angular positions around the bore. In this case, a measure of the lateral position of the elongate component may be derived based on a comparison of the detected parameters from coils at different angular positions. This is achieved because as the elongate component moves laterally, the interaction with the electromagnetic fields generated by different coils changes in a different manner. By way of example, if the elongate component moves away from a first coil and towards a second coil, then the interaction with the electromagnetic fields generated by the first coil decreases and the interaction with the electromagnetic fields generated by the second coil increases. In a corresponding manner, the detected parameters of the electrical oscillation in different coils changes differently which allows the detected parameters to be used to sense the lateral position of the elongate component.

Optionally, the sensor system may also include at least one additional coil extending around the bore for generating an electromagnetic field directed along the bore. In that case, a measure of the axial position along the bore of a feature in the elongate component may be derived based on the detected parameters from the at least one additional coil.

The detected parameters may be used to derive a measure of the axial position along the bore of a feature in the elongate component, for example a joint section in the case that the elongate component is a tubular which could include as casing, tubing, tools or a drill string of drill pipes connected by joint sections.

Alternatively or additionally to having different angular positions, the coils may include coils at different axial positions along the axial direction of the bore. In that case, a measure of the axial position along the bore of a feature in the elongate component may be derived based on a comparison of the detected parameters from coils at different axial positions.

The coils may comprise at least two sets of electromagnetic coils, the coils within each set being arranged at different angular positions around the bore overlapping in the axial direction, the sets of coils being separated along the axial direction of the bore. In that case, the measure of the axial position along the bore of a feature in the elongate component may be derived based on a comparison, as between at least one pair of sets of coils, of a combined measure of the detected parameters from each coil in the respective set.

Thus, for sensing the axial position along the bore, the coils at different axial positions, for example the coils from each set, are used in combination. The oscillating electromagnetic fields produced by the electrical oscillations interact with the contents of the bore. Features in the elongate component having a different interaction with the EM field of the coils from the remainder of elongate component, typically by having a different external shape, may be detected. As the feature and the remainder of the elongate component have different interactions with the electromagnetic fields, the detected parameter of the electrical oscillation changes depending on whether the feature and the remainder of the elongate component are within the oscillating electromagnetic fields generated by the coils. This allows the detected parameters to be used to sense the presence of a feature aligned with the coils.

If the elongate component stayed aligned with the axis of the bore, then in theory the detected parameter of a single axial position, for example a single set of coils, would be sufficient to detect the presence of a feature. However, in practice the detected parameter will also vary with the lateral position of the elongate component in the bore. That is, as the elongate component moves laterally towards a coil, the interaction with the electromagnetic fields increases, thereby changing the detected parameter. Thus, from the detected parameter from a single axial position, it is difficult to distinguish between the case of a feature being present when the pipe is centralized and at the axis of the bore, and the case when a feature is not present but the pipe is displaced away from the axis of the bore.

However, by considering combined measures of the detected parameters from coils at different axial positions, for example coils in the respective sets, and basing the measure of the axial position along the bore on a comparison of the detected parameters from such coils, for example a combined measure of the detected parameters as between at least one pair of sets of coils, then the axial position may be sensed reliably, regardless of any lateral displacement of the elongate component from the axis of the bore.

The method may be applied to a wide range of elongate components, typically in a bore in apparatus for use in the oil and gas industry. By way of non-limitative example, the elongate element may comprise a drill string of drill pipes connected by joint sections, but also casing and tubing.

Advantageously, with the specific arrangement of coils, this the detected parameters to be used to simultaneously derive (1) a measure of the axial position along the bore of a feature in the elongate component, and (2) a measure of the lateral position of the drill string.

The sensor system may further comprise a processing circuit supplied with the detected parameters and arranged to derive a measure of the electromagnetic properties of the contents of the bore in a region adjacent each respective coil from the detected parameters of the electrical oscillations generated in that coil.

In this manner, the sensor system may measure the electromagnetic properties of the contents of the bore in plural regions. This may be considered as a form of imaging of the contents of the bore, and can provide enhanced information about the contents of the bore, either in the absence or presence of an elongate component.

The coils may include coils at different angular positions around the bore and coils at different axial positions along the axial direction of the bore.

Advantageously, the detected parameters to be used to simultaneously derive measures of position (lateral and/or lateral position as discussed above) of an elongate element and of the electromagnetic properties of the contents of the bore. This means that the same coils may be used to provide both forms of sensing in an integrated manner.

Advantageously the coils may be driven by a marginal oscillator which provides a high stability of the oscillation frequency.

The parameter of the electrical oscillations which is detected may be the oscillation frequency.

According to a second aspect of the present invention, there is provided a method of sensing an elongate component inside a bore that corresponds to the sensor system in accordance with the first aspect of the invention.

BRIEF DESCRIPTION OF THE DRAWINGS

Embodiments of the present invention will now be described by way of non-limitative example with reference to the accompanying drawings, in which.

DETAILED DESCRIPTION

Figure 1:
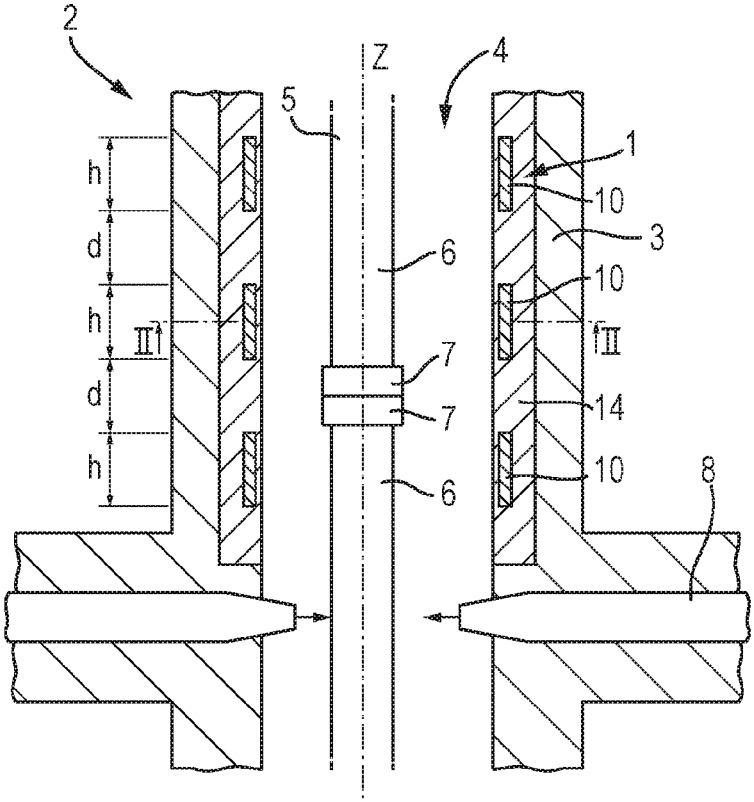
FIG. 1 is an axial cross-sectional view of a sensor system applied in a BOP apparatus.
Figure 2:
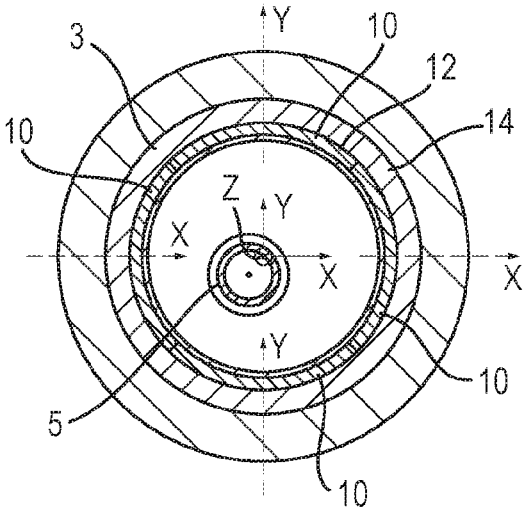
FIG. 2 is a lateral cross-sectional view of the sensor system, taken along line II-II in FIG. 1.

FIGS. 1 and 2 show a sensor system 1 that is implemented in BOP apparatus 2 and arranged as follows.

The BOP apparatus 2 comprises a tube 3 that defines a bore 4 extending along an axis Z. The bore 4 may be a bore of used in oil and gas extraction or production. The bore 4 may be a pipe bore, riser or flowline, or downhole. The bore 4 may be a casing, production tubing or a well bore in an 'open-hole' well.

In use, a drill string 5 is passed inside the bore 4. The drill string 5 includes a series of drill pipes 6 connected by joint sections 7 which provides a screwable connection between the drill pipes 6. The drill string 5 is intended to be aligned with the axis Z of the bore 4 but in practice may become laterally offset as shown in FIG. 2. Thus, in this example, the drill string 5 is the elongate element to be sensed, and the joint sections 7 are the features whose axial position is to be detected. Herein, the word "lateral" with reference to the position of the drill string 5 (or more generally any elongate component in a bore) can be taken to refer to a direction that is radial with respect to the axis of the bore 4.

The BOP apparatus 2 also comprises shear rams 8 that may operate in an emergency to cut through the drill string 5 with the intention of sealing the bore 4 and hence a well in which the BOP apparatus 2 is employed.

The sensor system 1 includes three annular coil strips 10 that are wrapped around the bore 4 inside the wellbore tube 3. In general, there may be any plural number of coil strips 10. The three coils strips 10 are positioned above the shear rams 8 which is advantageous when the sensing is used to control operation of the shear rams 8, but is not essential. Desirably, the distance between the shear rams 8 and the most distant coil strip 10 should be less than the length of the drill pipes 6 in the drill string 5, which is typically of the order of 10 m.

Figure 3:
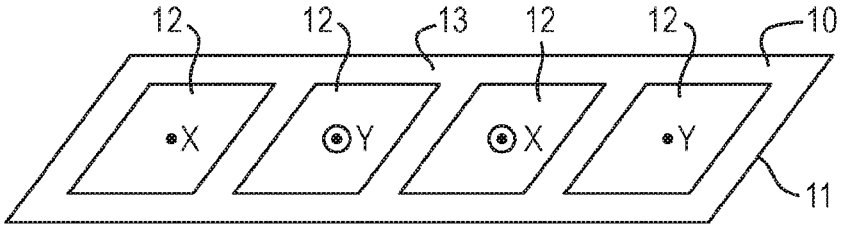
FIG. 3 is an unwrapped, plan view of a coil-strip of the sensor system.

One of the coil strips 10 is shown unwrapped in FIG. 3 extending linearly between two inclined ends 11.

The coil strip 10 supports a set of four identically shaped coils 12 with equal spacing along the coil strip 10.

In one construction, the coil strip 10 is formed as a flexible PCB sheet 13 on which the coils 12 are formed in a conventional manner, for example by printing or etching. In FIG. 3, for clarity only the outer boundary of the coils 12 are shown, but in fact the coils 12 are formed by multiple conductive turns.

In another construction where the coil strip 10 is not a flexible PCB sheet, the coils 12 may be formed from wire. In that case, the wire may be any suitable conductive material such as stainless steel, copper or Inconel.

The coil strip 10, and hence the coils 12 themselves, are embedded in a non-metallic lining 14 of the wellbore tube 3, wrapped around the bore 4 so that the inclined ends 11 of the coil strip 10 butt against each other to form the coil strip 10 into an annular shape. This results in the coils 12 within the set conforming to the inner surface of the bore 4 and being arranged circumferentially around the bore 4 facing the bore 4, with the coils 12 within the set overlapping in the axial direction. In the example shown in FIG. 1, the non-metallic lining 14 extends along a section of the tube 3.

As the coils 12 face the bore 4, the EM field generated by the coils 12 is directed laterally into the bore 4. This may be achieved by the winding axis around which the turns of the coils 12 are wound is directed laterally into the bore 4, preferably perpendicular to the surface of the bore 4. Thus, the EM field generated by the coils 12 senses the contents of the bore 4.

The coils 12 are at different angular positions around the bore 4. Specifically in this example, as a result of their equal spacing along the coil strip 10, the coils 12 are arranged circumferentially around the bore 4 with equal angular spacing, as shown in FIG. 2.

This arrangement of the coils 12 in the non-metallic lining 14 is a convenient way to mount the coils 12 in the tube 3 of the bore 4. It results in the coils being disposed behind some of the material of the non-metallic lining 14 which therefore protects the coils 12 from the contents of the bore 4. The non-metallic lining 14 may be a suitable composite, such as carbon fiber or fiber glass, or a plastic, for example Polyether ether ketone (PEEK), or an elastomer, for example a rubber. The material of the non-metallic lining 14 may be of a type known to be suitable for use as a lining of a bore 4 in oil and gas applications. Suitable materials for the non-metallic lining 14 include, without limitation: polyisoprene, styrene butadiene rubber, ethylene propylene diene monomer rubber, polychloroprene rubber, chlorosulphonated polyethylene rubber, 'Viton' or nitrile butadiene rubber. The material may also be a mixture of these and/or other materials.

In this example, the coils 12 are shaped as parallelograms. As a result, the coils 12 within the set overlap in the axial direction, that is parallel to the axis Z of the bore 4. This arrangement causes the EM fields generated by each coil 12 also to overlap in the axial direction. That reduces the formation of dead-zones at angular positions between the coils 12 where the detection sensitivity is reduced.

In this example, the coils 12 of a set formed on a single coil strip 10 are each arranged at the same axial position along the bore 4. However, the coil strips 10 and hence the coils 12 of each set are separated along the axial direction of the bore 4. As shown in FIG. 1, the coils 12 have an axial extent h and a separation d. This means that the coils 12 of each set are at different axial positions along the bore 4.

As discussed in more detail below, the set of coils 12 formed in each coil strip 10 senses the joint section 7 when aligned therewith. Therefore, to maximize the sensitivity, the axial extent h of the set of coils 12 is preferably of the same order as the axial extent of the joint section 7. Similarly, to maximize the discrimination between the sets of coils 12, the separation d is preferably greater than the axial extent of the joint section 7. Although not essential, to achieve these advantages, the coils of each set may typically be separated along the axial direction of the bore by a separation d that is at least the axial extent h of the coils 12 within a set.

A related point is that if the different sets of coils 12 are driven at the same time (as discussed further below), then preferably the separation d is sufficiently large that the EM fields produced by coils 12 in different sets do not interact with each other. Typically, this will imply that the separation d is larger than the axial extent h of the coils 12, preferably by at least a factor of 2.

Another practical constraint is that the coils 12 should desirably be close enough to ensure that there cannot be a joint section 7 aligned with two different sets of coils 12 at the same instant. However, since the distance between the joint sections 7 in a drill string 5 is large, typically 10 m or more, this is unlikely to be a problem for most types of drill string 5.

Figure 4:
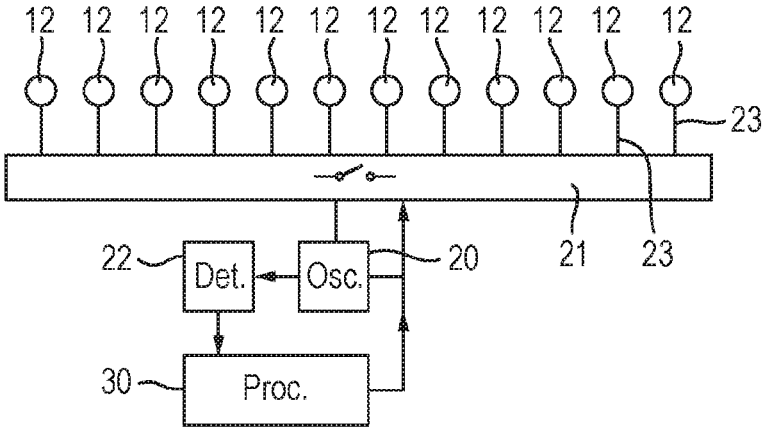
FIG. 4 is a schematic circuit diagram of the sensor system.

The circuitry of the sensor system 1 is shown in FIG. 4 and includes an oscillator circuit 20 and a detection circuit 22 which may be implemented on a common circuit board.

The circuitry of the sensor system 1 also includes a switch arrangement 21 arranged to connect the oscillator circuit 20 selectively to any one of the twelve coils 12 in the three sets of coils 12. The switch arrangement 21 is connected to the coils 12 through cables 23. As described in more detail below, the oscillator circuit 20 drives electrical oscillations in the coil 12 to which it is connected. Accordingly, the oscillator circuit 20 and the switch arrangement 21 together form a drive circuit arrangement that may be controlled to selectively generate electrical oscillations in any one of the coils 12 at a time. As described below, in use the switch arrangement 21 is switched to connect the oscillator circuit 20 to each respective coil 12 in turn. The electrical oscillations in the coils 12 cause the coils 12 to produce oscillating EM fields that, due to arrangement of the coils described above, interact with the contents of the bore 4.

The oscillator circuit 20 and the coils 12 are designed to drive electrical oscillations that are radio frequency (RF) electrical oscillations. In general, the electrical oscillation may be any radio frequency, which as used herein, may in general be considered to be a frequency within the range from 3 kHz to 300 GHz.

Increasing the frequency of the electrical oscillation increases the sensitivity, for which reason the frequency may typically be at least 10 kHz. Typically, the frequency of the drive signal may be at most 100 MHz or at most 1 GHz, as higher frequencies may require more complicated electronics.

The resonant frequency of an oscillator depends upon the inductance and capacitance of the tank circuit 42. In practice, the major contribution to the capacitance is usually the capacitance of the cables 23 connecting the coil 12 to the switch arrangement 21 due to practical restrictions requiring the oscillator circuit 20 to be sited remotely from the coils 12.

Making the resonant frequency as high as possible can be done by reducing the inductance of the coil 12 and the capacitance of the cable 23 as much as possible. However, the coils 12 must be made large enough to either fit around the bore 4 of the BOP arrangement 1 and to provide sufficient response to detect the drill string 5 across the lateral dimensions of the bore 4. The coils 12 might typically be slightly smaller, but will typically be of the same order as the diameter of the bore 4. For example, if the bore 4 has a diameter of 50 cm, then its circumference is roughly 160 cm. With four coils 12 spaced equally around the circumference, the length of the side of the coil 12 will then approach 40 cm. With these coil dimensions, it is likely that the resonance frequency of a practical system will be at least 100 kHz and/or at most 300 MHz.

The detection circuit 21 is arranged to detect the frequency of the electrical oscillations which is currently being driven, the frequency being a parameter of the electrical oscillations that is dependent on the interaction of the EM field with contents of the bore 4. Therefore, the detection circuit 21 forms an arrangement arranged to detect the frequency of the electrical oscillations generated in each coil 12, when the switch arrangement 21 is in use switched to connect the oscillator circuit 20 to the coils 12 in turn.

The circuitry of the sensor system 1 also includes a processing circuit 30 that is supplied with a signal representing the frequency of the electrical oscillations detected by the detection circuit 22. The processing circuit 30 analyses the detected frequency of the electrical oscillations and may be any form of circuit that is capable of performing such an analysis, for example a dedicated hardware or a microprocessor running an appropriate program.

The processing circuit 30 also controls the operation of the oscillator circuit 20 and the switching of the switch arrangement 21 to connect the oscillator circuit 20 to each respective coil 12 in turn. This allows polling of the coils 12 over time. That is, as the switching occurs, the processing circuit 30 is supplied by the detection circuit 21 with the detected frequency from each respective coil 12 in turn. The processing circuit 30 processes the detected frequencies from all coils 12 to provide various measures of the position of the drill string 5, as discussed below.

Figure 5:
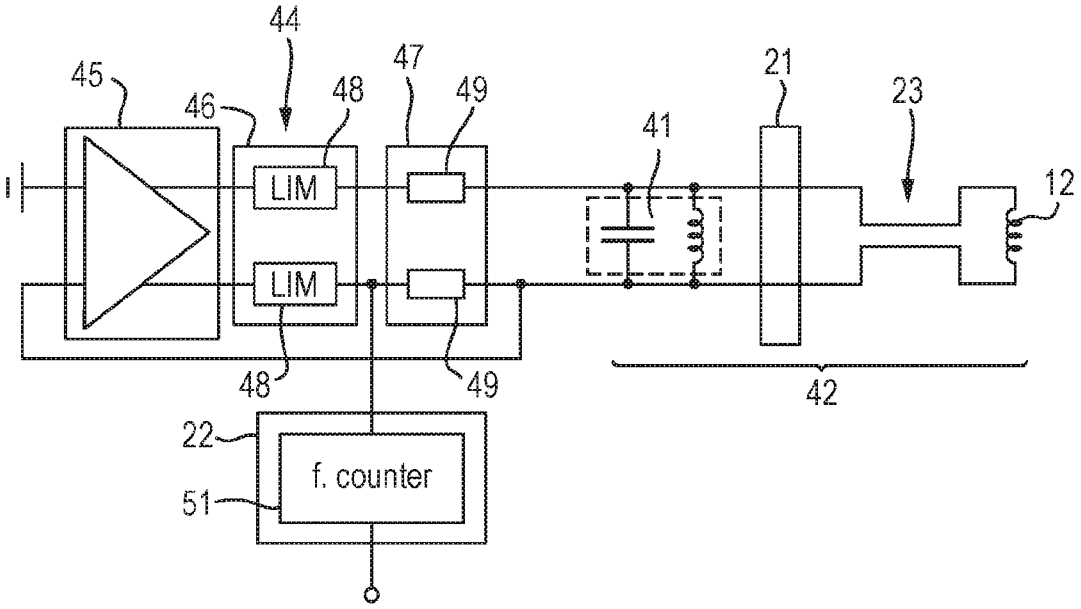
FIG. 5 is a detailed circuit diagram of the drive circuit and detection circuit of the sensor system.

The form of the oscillator circuit 20 and a detection circuit 21 is shown in more detail in FIG. 5, which shows a single one of the coils 12 to which the oscillator circuit 20 may be connected through the switch arrangement 21. In particular, the oscillator circuit 20 is a marginal oscillator and is arranged as follows.

The oscillator circuit 20 optionally comprises further reactive elements 41 connected in parallel to the coil 12, so that the coil 12, the further reactive elements 41 and any capacitance in the cable 23 together form a tank circuit 42. In FIG. 3, the reactive elements 41 are illustrated schematically as an inductor and a capacitor in parallel, but in general the tank circuit 42 could include any arrangement of reactive elements, one of which is the coil 12.

The oscillator circuit 20 comprises an oscillator circuit 20 arranged in this example as a marginal oscillator, as follows. The oscillator circuit 20 is a drive circuit arranged to drive oscillations in the tank circuit 42.

The oscillator circuit 20 includes a non-linear drive circuit 44 that provides differential signaling in that it supplies a differential signal pair of complementary signals across the tank circuit 42. The complementary signals are each formed with respect to a common ground, but in anti-phase with each other, although they may have unbalanced amplitudes as described further below. Thus, the overall signal appearing across the tank circuit 42 is the difference between the complementary signals and is independent of the ground, which provides various advantages to the sensor system 1.

The non-linear drive circuit 44 has the following arrangement that sustains the oscillation on the basis of one of the complementary signals supplied back to the non-linear drive circuit 44. In this example, the oscillator circuit 20 is a Robinson marginal oscillator including a separate gain stage 45 and limiter stage 46, the limiter stage 46 driving a current source stage 47. Although use of a Robinson marginal oscillator is not essential, this provides the advantages of a Robinson marginal oscillator that are known in themselves.

The gain stage 45 is supplied with a single one of the complementary signals fed back from the tank circuit 42 and amplifies that signal to provide a differential pair of amplified outputs. The gain stage 45 is formed in this example by an operational amplifier that amplifies the complementary signal supplied back from the tank circuit 42. That complementary signal from the tank circuit 42 is DC coupled to one of the inputs of the operational amplifier, the other input of the operational amplifier being grounded.

The limiter stage 46 is supplied with the differential pair of amplified outputs from the gain stage 45 and limits those outputs to provide a differential pair of limited outputs. In this example, the limiter stage 46 is formed by a pair of limiters 48 that each limit the amplitude of one of the differential pair of amplified outputs.

The current source stage 47 is driven by the differential pair of limited outputs from the limiter stage 46 and converts them into the differential signal pair of complementary signals that are supplied across the tank circuit 42. The current source stage 47 converts the voltage signals into currents and has a differential output. The current source stage 47 comprises a pair of current sources 49 each receiving one of the limited outputs. Each current source 49 may be formed by a passive element, for example a resistor or a capacitor that converts the voltage of the input into a current. Alternatively, each current source 49 may be an active component such as a semiconductor device or an amplifier. The feedback of the complementary signal from the tank circuit 42 to the gain stage 45 is positive and in combination with the action of the limiter stage 46 builds up and sustains the oscillation of the tank circuit 42 at the natural frequency of the tank circuit 42.

The current sources 49 may be identical so that the complementary signals supplied across the tank circuit 42 are of equal amplitude. However, advantageously the current sources 49 may be unbalanced, that is have different voltage-to-current gains. As a result, the complementary signals supplied across the tank circuit 42 have unbalanced amplitudes. By creating such a difference in the amplitudes of the complementary signals to ensure that the inverting output is more dominant than the non-inverting output, reliable starting of the oscillator circuit 20 is achieved. The unbalanced nature of the complementary signals provides an anti-hysteresis effect.

The oscillator circuit 20 may have the construction disclosed in greater detail in WO-2015/015150 which is incorporated herein by reference.

The tube 3 may be a composite fluid conduit, for example of the type disclosed in greater detail in WO-2012/153090, which is incorporated herein by reference. The method of fabrication of the composite fluid conduit disclosed in WO-2012/153090 may be exploited to form the non-metallic lining described above.

The detection circuit 21 is arranged to detect the frequency of the electrical oscillations. To achieve this, the detection circuit 21 comprises a frequency counter 51, which may be implemented in a microcontroller. The frequency counter 51 is supplied with one of the outputs of the limiter stage 46 (although in general it could be supplied with an oscillating signal from any other point in the oscillator circuit 20). The frequency counter 51 serves as a detector that detects the frequency of the oscillation of the tank circuit 42 and outputs a signal representing that frequency of oscillation. Such a frequency counter 51 is sufficient to determine the oscillation frequency since the movement of the drill string 5 will be sufficiently slow to allow an update that is useful for practical purposes.

Thus, the sensor circuit 1 uses an RF oscillator circuit driving the coil 10 to sense a metallic object in the vicinity of the coil 10 on the basis of change in electrical parameters of the oscillation caused by change in the interaction of the object with the EM field. In general terms, such an operating principle is known. However, particular advantage is achieved by the choice of a marginal oscillator as the oscillator circuit 20 uses frequency as the parameter of the electrical oscillations that is detected. A marginal oscillator provides high stability and sensitivity. In addition, the frequency shifts caused by the movement of the drill string 5 are virtually unaffected by any fluctuations in the composition of the fluid in the bore 4. Such fluctuations will change the dielectric properties of the fluid and affect the response of oscillators that monitor the amplitude of the voltage oscillations to generate the target information.

In addition, given that the coils 12 are polled successively over time, the use of a marginal oscillator as the oscillator circuit 20 also provides the advantage of providing a rapid stabilization response when a coil 12 is activated by being connected to the oscillator circuit 20 by the switching arrangement 21. This allows a rapid complete cycle of polling all the coils 12, typically of the order of half a second. This allows sensing of relatively rapid movements of the drill string 5.

That said, in general terms, the detection circuit 22 could be arranged to detect parameters of the electrical oscillations other than the frequency, alternatively or additionally to detecting the frequency. In general, any other parameter could be additionally or alternatively detected, for example the amplitude or Q factor of the electrical oscillations. Where the amplitude of the electrical oscillations is detected, the amplitude may be differentially determined, which is not essential, but further improves the stability and sensitivity, and reduces the impact of thermal drift, for example.

The processing by processing circuit 30 of the detected frequencies supplied thereto will now be described.

Herein, the coils 12 in the uppermost set show in FIG. 1 will be labelled C11, C12, C13, and C14, and their detected frequencies will be F11, F12, F13, and F14 respectively. Similarly, the coils 12 in the middle set show in FIG. 1 will be labelled C21, C22, C23, and C24, and their detected frequencies will be F21, F22, F23, and F24 respectively. Finally, the coils 12 in the lowermost set show in FIG. 1 will be labelled C31, C32, C33, and C34, and their detected frequencies will be F31, F32, F33, and F34 respectively.

The processing circuit 30 derives both (1) a measure of the axial position along the bore 4 of a joint section 7 in the drill string 5, and (2) a measure of the lateral position of the drill string 5, as follows.

The oscillation frequency of each coil 12 will vary depending upon the cross-section of the part of the drill string 5 aligned with the sensing region of the coil 12, and the lateral position of the drill string within the bore 4. At any given lateral position for the drill string 4, the presence of a joint section 7 will cause a greater oscillation frequency than a drill pipe 6, because a joint section 7 has a greater diameter and a greater mass of metal than a drill pipe 6.

The measure of the axial position along the bore 4 of a joint section 7 in the drill string 5 is derived as follows.

In respect of each set of coils 12, a combined measure of the detected frequencies from each coil 12 in the respective set is derived. The combined measure may be the sum of the detected frequencies from each coil 12 in the respective set. In that case, the combined measures F1, F2 and F3 for the respective sets may be derived using the following equations:

$$F1=F11+F12+F13+F14$$

$$F2=F21+F22+F23+F24$$

$$F3=F31+F32+F33+F34$$

The combined measures are therefore a composite signal that may be considered as equivalent to the signals that would be obtained if each set of coils were replaced by a single coil extending around the bore 4. Thus, the measure of the axial position along the bore 4 of a joint section 7 may be derived based on a comparison of the combined measures, as follows.

Differential measures of combined measures F1, F2 and F3 of the detected frequencies from each coil 12 in the respective sets are derived. In this example including at least three sets of EM coils, and differential measures are derived in respect of each pair of sets of coils 12 within the total number of sets of coils 12, so as to compare each pair of sets of coils 12. That is, a differential measure ΔF12 may be derived in respect of the pair of coils C1 and C2, ΔF23 may be derived in respect of the pair of coils C2 and C3, and ΔF31 may be derived in respect of the pair of coils C3 and C1.

The differential measure may be the difference between the combined measures. In this case, the differential measures ΔF12, ΔF23 and ΔF31 for the respective sets may be derived using the following equations:

$$\Delta F12=F1-F2$$

$$\Delta F23=F2-F3$$

$$\Delta F31=F3-F1$$

As an alternative, the differential measure may be the difference between the combined measures normalized by the normalized by the total of the combined measures from the respective sets. In this case, the differential measures ΔF12, ΔF23 and ΔF31 for the respective sets may be derived using the following equations:

$$\Delta F12=(F1-F2)/(F1+F2)$$

$$\Delta F23=(F2-F3)/(F2+F3)$$

$$\Delta F31=(F3-F1)/(F3+F1)$$

Other measures that provide a comparison between the combine measures may alternatively be derived and used to sense the axial position. For example, the measure may be the ratio of the combined measures.

The differential measures ΔF12, ΔF23 and ΔF31 provide a measure of the axial position along the bore 4 of a joint section 7 in the drill string 5, because the presence of a joint section 7 in the EM field produced by the coils 12 of a set changes the combined measure, as follows.

Suppose that the nearest joint section 7 between the drill pipes 6 is not axially aligned with any of the sets of coils 12 so that all three sets of coils are interacting with a drill pipe 6 of standard cross-section. Also suppose that the drill string is centrally located within the coils 12 on the axis Z of the bore 4. The values of the combined measures F1, F2, and F3 of the three sets of coils 12 values of will be close together and the differential measures ΔF12, ΔF23 and ΔF31 will all be small.

If the drill string 5 moves from the central location on the well-bore axis, the values of the combined measures F1, F2, and F3 may change, but as any inclination of the drill string 5 from the axis Z is very small, the lateral displacement of the drill string 5 at the level of each set of coils 12 will be the same. As a result, the differential measures ΔF12, ΔF23 and ΔF31 will not be affected by the lateral position of the pipe and will continue to be small, for example not exceeding a chosen threshold. This means that each of the differential measures ΔF12, ΔF23 and ΔF31 having a low value is indicative of a joint section 7 not being aligned with any of the sets of coils 12 regardless of the axial displacement of the drill string 5.

Now suppose that the vertical movement of the drill string 5 causes a joint section 7 to become aligned with the uppermost set of coils 12, i.e. coils C11, C12, C13 and C14. In that case the combined measure F1 in respect of that set of coils 12 will increase, causing the differential measures derived in respect of that set of coils 12, i.e. the differential measures ΔF12 and ΔF31 to change, in particular by the differential measure ΔF12 increasing and the differential measure ΔF31 becoming negative. However, the differential measure ΔF23 derived in respect of the other set of coils 12 will not change and remains small. Thus, the changes in differential measures ΔF12, ΔF23, and ΔF31 provide a unique signature for the presence of the uppermost set of coils 12. Similarly, alignment of the joint section 7 with the other set of coils 12 generates other unique signatures. This means that if one of the differential measures becomes large and positive, for example increasing above a positive threshold and another is large and negative, for example decreasing below a negative threshold, then the joint section 7 is unambiguously located in the sensing region of the corresponding set of coils 12 regardless of the displacement of the drill string 5 from the axis Z of the bore 4.

The explanation above describes the derivation of a measure of the axial position that provides a binary decision in respect of whether a joint section 7 is aligned with a given set of coils 12. More generally, the differential measures ΔF12, ΔF23, and ΔF31 change continuously as the joint section 7 passes the sets of coils 12, allowing derivation of a measure of position that varies continuously with the axial position of the joint section 7.

Besides the position of the drill string 7, various other factors can also cause the detected frequencies of each coil 12 to change, for example the temperature and pressure of the fluid within the bore 4. The impact of such effects is reduced by basing the measure of the axial position along the bore 4 of a joint section 7 on a comparison of the combined measures F1, F2 and F3, that is on the differential measures ΔF12, ΔF23, and ΔF31 in the above example. Thus, this gives a more stable and accurate measure of the axial position than using a single one of the combined measures F1, F2 and F3.

The processing circuit 30 outputs a signal representing a measure of the axial position along the bore 4 of a joint section 7 in the drill string 5, derived from the differential measures ΔF12, ΔF23, and ΔF31, for example a signal indicating that the joint section 7 is aligned with one of the sets of coils 12, or a measure of position that varies continuously with the axial position of the joint section 7.

In the above example, the differential measures ΔF12, ΔF23 and ΔF31 derived from the different sets of coils 12 provide a measure of the axial position along the bore 4 of a joint section 7 in the drill string 5. More generally, it is possible that the coils 12 have other arrangements in which coils 12 are at different axial positions along the bore 4. In that case, a measure of the axial position can be derived from comparison of the detected frequencies of the coils 12 at different axial positions in a similar manner.

The use of the sets of coils 12 in which the coils are arranged at different angular positions around the bore 4 also allows derivation of the measure of the lateral position of the drill string 5. This is in contrast to a sensor system employing a single coil extending around the bore 4 in place of each set of coils 12. In particular, the measure of the lateral position of the drill string 5 may be derived based on a comparison of the detected frequencies from coils 12 at different angular positions as follows. To illustrate the reason for this, consider a pair of coils 12 that face each other across the bore 4, and assume that the drill string 5 is centrally located on the axis Z of the bore. In this case, the oscillation frequencies should be identical. Now suppose that the drill string 5 moves laterally displaced towards one coil and away from the other, for example as shown in FIG. 2 in which the drill string 5 has moved laterally towards the leftmost coil 12. The oscillation frequency of the coil 12 that is closer to the drill string 5 will increase while the oscillation frequency of the other coil 12 will decrease. Thus, a comparison of the oscillation frequencies of coils that are aligned with a given lateral axis X or Y can provide a measure of the lateral position of the drill string 5 along that lateral axis X or Y.

The lateral position along different lateral axes X and Y can be derived from comparison of different coils aligned with the respective lateral axes X and Y. This provides for a measure of the lateral position in two dimensions corresponding to two lateral axes X and Y that are orthogonal, although there may be cases where sensing along only a single lateral axis X or Y is performed.

In the simple geometrical arrangement of four coils 12 as in the sensor system 1 described above, the lateral position along each lateral axis X and Y is simply made by comparison between the two coils 12 that oppose each other along each lateral axis X and Y. If the coils 12 had a different geometrical arrangement then a similar comparison could be made with appropriate scaling of the frequencies in accordance with the geometrical alignment of the coils 12 to the lateral axis X or Y being considered.

To provide the comparison, there may be derived, in respect of at least one of the lateral axes X and Y, a respective differential measures of the detected frequencies from coils 12 aligned with that lateral axis X or Y, for example the difference between the frequencies. For example, in respect of the lateral axis X along which coils C11 and C13 are aligned, the differential measure ΔF1113 of position along that lateral axis X may be calculated in accordance with the equation:

$$\Delta F1113 = F11 - F13$$

Similarly, in respect of the lateral axis Y along which coils C12 and C14 are aligned, the differential measure ΔF1214 of position along that lateral axis Y may be calculated in accordance with the equation:

$$\Delta F1214 = F12 - F14$$

Such differential measures may be derived from the frequencies in respect of the coils 12 in each of the sets. The frequencies from the other sets of coils 12 at different axial positions can be analyzed in a similar way, and should give the same axial position in the absence of inclination of the well string 5. If the well string is inclined in the bore 4, the differential measures from each set of coils 12 can provide a measure of this inclination.

As an alternative, the differential measures may be the difference between the detected frequencies from coils 12 aligned with a given lateral axis X or Y normalized by the total of the detected frequencies from those coils 12 aligned with a given lateral axis X or Y. For example, in this case the differential measures ΔF1113 and ΔF1214 may be calculated in accordance with the equations:

$$\Delta F1113 = (F11 - F13)/(F11 + F13)$$

$$\Delta F1214 = (F12 - F14)/(F12 + F14)$$

Other measures that provide a comparison between the frequencies of coils 12 aligned with a lateral axis X or Y may alternatively be derived and used to sense the axial position. For example, the measure may be the ratio of those frequencies.

The processing circuit 30 outputs a signal representing a measure of the lateral position of the drill string 5, for example derived from the differential measures or other measure that provides a comparison between the frequencies of coils 12 aligned with a lateral axis X or Y.

In the above example, the differential measures ΔF1113 and ΔF1214 derived from a single set of coils 12 provide a measure of the lateral position of the drill string 5. More generally, it is possible that the coils 12 have other arrangements in which coils 12 are at different axial positions along the bore 4. In that case, a measure of the lateral position can be derived from comparison of the detected frequencies of the coils 12 at different angular positions in a similar manner.

It is possible to envisage other sensing technologies being used to determine the axial position of the drill string 5. For example, it would be possible to deduce the axial position using ultrasonic sensors that measure the time of flight of ultrasonic pulses that bounce off the drill string 5. However, such other technologies would be more complex and expensive than the sensing system 1 described above, and there would be a risk of being affected by changes in the properties of the fluid within the bore 4, whereas the sensing system 1 is relatively insensitive to changes in the fluid properties.

The measures of position of the drill string 5 have a practical application in being used to control the operation of the shear rams 8 of the BOP assembly 1. For example, the measure of the axial position along the bore 4 of a joint section 7 in the drill string 5 may be used to prevent operation of the shear rams 8 when the joint section 7 is aligned with the shear rams 8. For example, a simple control algorithm would be only to operate the shear rams 8 when the joint section 7 is aligned with one of the sets of coils 12, meaning that there can be no joint section 7 aligned with the shear rams 8. Similarly, the measure of the lateral position of the drill string 5 may be used to allow operation of the shear rams 8 when the drill string 5 is aligned with the axis of the bore 4 and to prevent operation of the shear rams 8 when the drill string 5 is axially offset.

The processing circuit 30 also derives a respective measure of the EM properties of the contents of the bore 4 from the detected frequency from each coil 12, that is from each of frequencies F11, F12, F13, F14, F21, F22, F23, F24, F31, F32, F33 and F34. As the EM fields generated by each coil 12 are directed into a different respective regions adjacent each coil 12, the derived measures of EM properties are measures of the EM properties in those different regions. Thus, the derived measures of EM properties may be considered as a form of imaging of the contents of the pipe. For example, in the arrangement of coils 12 shown in FIG. 1 shown in FIGS. 1 to 3 and described above, the EM properties are measured at the axial positions of each of the sets of coils 12 and, in respect of each set, at the different angular positions of the coils 12 within the set. This can provide enhanced information about the contents of the bore 4.

The coils 12 may have the construction disclosed in WO-2009/147385, which is incorporated herein by reference, so that they include for example features, discontinuities or notches that improve resolution when detecting the position of an elongate component while also improving sensor stability and contracting drift and other environmental effects.

The measures of EM properties derived by the processing circuit 30 may be of various different types, depending on the nature of the contents of the bore 4 and the EM properties of interest. By way of non-limitative example, the measures of EM properties may be those described in WO-2012/007718, WO-2015/015150 or GB-2,490,685.

In the case of the contents being a slurry, or a fluid with particulate or solid matter, the derived EM properties may be used to discriminate between the solid, water and oil content of a flowing matrix such as waste, brine, drilling cuttings, metallic particulate (in the case of lubrication or hydraulic fluid), mining waste, soil, plant matter (in the case of a fermentation process or biomass) or sewage.

In one embodiment, the sensor system 1 may be used to interrogate different locations for different targets or a complex matrix, for example a multiphase flow or a slurry, that has separated or stratified into layers or segments of different composition due to gravity, pressure, temperature or density. A flowing or static multiphase fluid mixture or slurry may separate into layers of different density, for example as mixtures of hydrocarbons and water flow up production tubing to the well head the flow can be in distinct horizontal or annular layers of water, oil and bubbles of gas. Similarly, a slurry may separate with the solid or sand flowing along the bottom of a pipe.

The sensor system 1 may be used to interrogate and detect the composition of these segments by switching on specific coils 12, or pairs or layers of coils 12, to look at a given layer. In this way, a coil 12 or coils 12, at the bottom of a horizontal bore 4 may be switched on to analyze the content of the bottom layers of a pipe or tank (for example a separator of the type used in oilfield during production, well testing or exploration) to measure the composition of the lower layers which may be denser fluids such as saline water or solids or slurries.

Likewise, a coil 12 or coils 12 at middle of a horizontal bore may be activated to interrogate the middle strata which may lighter fluids such as oils, and finally a coil or coils at the top of a horizontal bore may be employed to illuminate the top levels of static or flowing fluids or slurries to analyze the contents of the lightest fluids such as gases or foams.

In a comparable manner outer layers of coils 12, or smaller coils 12 with shorter range, may be used to interrogate fluids that are outer most in the bore 4 and closed to the wall of the bore 4, and inner layers of coils 12, or larger coils 12 with longer range, may be used to interrogate and analyze fluids that are closer to the center of the bore 4. Using the data from different coils 12, coils of different geometries and/or coils 12 in different layers in this fashion, a complex, higher resolution image may be constructed of the contents of the bore 4.

The construction of complex arrays of coils 12 that are capable of interrogating targets or fluids that are in different regions or segments of a bore 4 could generate data from which three or four dimensional images of the contents of the bore 4 may be assembled and exploited to measure the composition of the bore 4 with greater accuracy and precision. In one sense, this can provide a cheaper, robust alternative to expensive computer tomography based on nuclear magnetic resonance relying on magnetic fields and sensitive detector electronics.

The arrangement of the sensor system 1 described above is not limitative and various modifications may be made, some examples being as follows.

The sensor system 1 described above includes three sets of EM coils 12 which is advantageous as it allows the measure of the axial position of a joint section in the drill string to be based on a majority decision as between each pair of sets of coils 12. Similar advantage may be achieved with larger numbers of sets of coils 12. However, the sensor system 1 could equally be applied with only two sets of coils 12 which still allows for comparison between the combined measures of frequency from each set of coils 12. More generally, the coils 12 could have other arrangements including coils at different angular positions around the bore and coils at different axial positions along the axial direction of the bore 4. In that case, the various measures can be derived in a similar manner based on comparisons of the detected frequencies in accordance with the positions of the coils 12, although the arrangement of the coils 12 in sets simplifies the analysis as described above.

Figure 6:
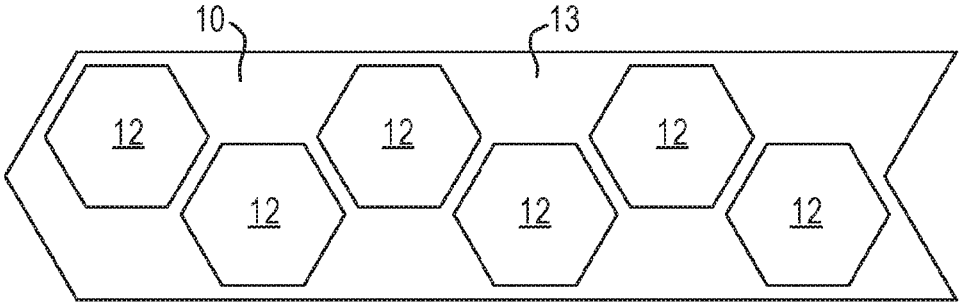
FIG. 6 is an unwrapped, plan view of an alternative coil-strip.

The particular configuration of the coils shown in FIG. 3 is not limitative, and in general, the shape, number and relative position of the coils 12 within each set can be varied to optimize the performance of the sensing system 1. For example, various tiled arrangements of coils 12 including coils 12 at different axial positions might improve the uniformity of the coverage inside the bore 4. By way of example, FIG. 6 shows a possible set of coils 12 which are hexagonal in shape and hexagonally packed in two rings.

The coils 12 may circles or ellipses, or may be polygons, for example hexagons, pentagons, triangles that may tessellate together to maximize sensor surface area, and improve imaging resolution when profiling the surface of an elongate and/or fluids in a bore.

The coils 12 may be formed in a layer in a composite, plastic or elastomer lining or cylinder, and could be implemented as an insert into a section of the tube 3 forming the bore 4.

Multiple, overlapping layers of coils 12 may constructed with different coil geometries to maximize measurement resolution, range, precision and accuracy without blind spots. The separate layers may be driven independently or together to interrogate regions of the bore 4. For example, the layers may be driven with an offset in time, or spatially, to detect and image an object with certain EM characteristics in the bore, such as a moving elongate or bubble of gas, or flowing fluid.

Figure 7:
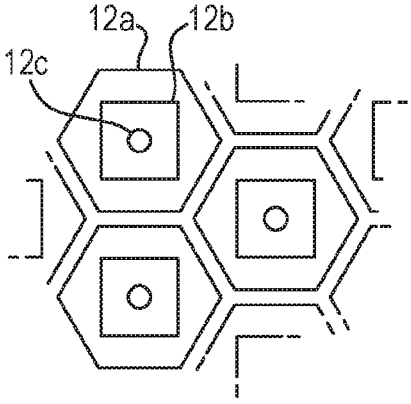
FIG. 7 is an unwrapped, plan view of an alternative arrangement of coils.
Figure 8:
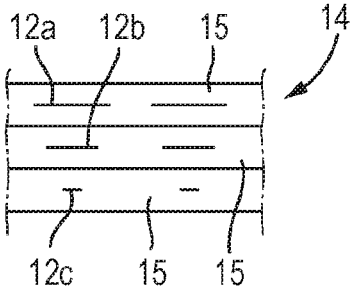
FIG. 8 is a side view of the coils shown in FIG. 7.

The coils 12 may include concentric coils of the same or different geometries to optimize sensor resolution, coverage and range. For example, the coils 12 may include an array of large hexagonal coils may provide for longer range, coarser measurement of fluids or elongate further away from the bore surface, and also smaller, concentric circular and/or rectangular coils to improve fine resolution measurement of targets such as fluids or elongate proximate to, in contact with or flowing along, the bore surface. By way of example, FIG. 7 shows part of a possible set of coils 12 including hexagonal coils 12*a*, concentric rectangular coils 12*b* and concentric circular coils 12*c*. This arrangement may be made by forming the hexagonal coils 12*a*, rectangular coils 12*b* and circular coils 12*c* in three different layers 15 of the non-metallic lining 14, as shown in FIG. 8.

Figure 9:
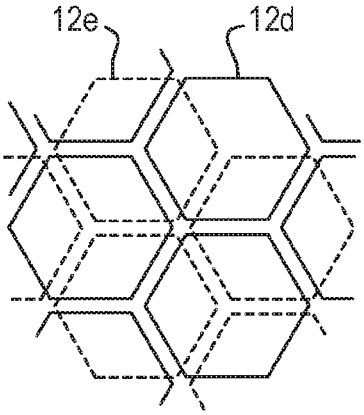
FIG. 9 is an unwrapped, plan view of an alternative arrangement of coils.
Figure 10:
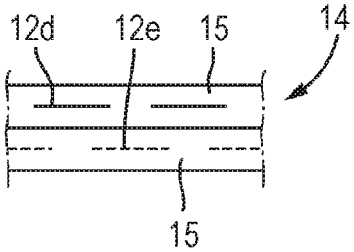
FIG. 10 is a side view of the coils shown in FIG. 9.

The coils 12 may include coils that are of the same shape but offset and overlapping to improve the resolution of the coverage. By way of example, FIG. 9 shows part of a possible set of coils 12 including a first array of coils 12*d* (shown in hard outline), and a second array of coils 12*e* (shown in dotted outline) of the same shape but offset and overlapping the first array of coils 12*d*. This arrangement may be made by forming the first array of coils 12*d*, and the second array of coils 12*e* in different layers 15 of the non-metallic lining 14 as shown in FIG. 10.

Complex, sensor geometries may be constructed from concentric, polygonal coils that form tessellated sensor arrays lining the bore 4 and sensing elongate components and/or fluid flowing inside the bore.

It is advantageous for derivation of the measure of lateral position of the drill string 5 if the number of coils 12 in a set is an even value so that pairs of coils 12 are aligned along a lateral axis facing each other across the bore 4. However, it is possible to derive a measure of lateral position even if an odd number of coils 12 are present, by mathematically processing the detected frequencies in accordance with their geometrical alignment relative to the lateral axis.

Although the drive circuit arrangement in the circuitry shown in FIG. 4 comprises a single oscillator circuit 20 and a switch arrangement 21 arranged to connect the oscillator circuit to each respective coil in turn, this is not essential.

In one alternative, each set of coils 12 may be provided with a separate oscillator circuit 20 and a switch arrangement 21. In this case, the switching arrangement 21 may be switched so that the oscillator circuit 20 generates electrical oscillations in the coils within each set in turn, but operating the sets of coils 12 at the same time. Interaction between the sets of coils 12 may be avoided by making their separation d sufficiently large that the EM fields generated thereby do not overlap.

In another alternative, each coil 12 may be provided with a separate oscillator circuit 20 and a switch arrangement 21. In that case, the coil 12 may still be operated at different times to avoid crosstalk. However, the coils 12 may be operated at the same time if the coils and oscillator circuits 20 are designed to oscillate at different frequencies chosen so that the generated EM fields do not interact.

However, provision of a single oscillator circuit 20 for all coils 12 of all sets provides the advantage of avoiding signal variation between different coils 12 which can reduce the sensitivity.

In general terms, the non-metallic lining 14 may be, without limitation, a cylindrical insert that is mounted inside a tube 3 such as a for example inside a riser or between a BOP stack and a riser, or inside a BOP stack. Such an insert may be mounted at multiple locations, for example at riser flanges, riser adapters and within the BOP stack itself. For ease of deployment, such a cylindrical insert may be constructed in a format that corresponds to the dimensions of an industry-standard insert so that it can be conveniently mounted inside risers, riser adapters, flanges or BOPs. In this way, the insert can be easily and quickly retro-fitted to existing risers and BOPs in the field. Electronic components, if required locally, may be mounted in a suitable cavity inside a seal, plate or gasket between flanges. At least one slot or feedthrough may be included for connecting cable between the insert and the electronic components.

Whereas the example shown in FIG. 1 relates to a sensor system 1 wherein the non-metallic lining 14 extends along a section of the tube 3, there will now be described some examples shown in FIGS. 9 to 11 wherein the non-metallic lining 14 is a seal that seals a joint between two sections 3*a* of the tube 3 forming the bore 4, the sections 3*a* being connected by flanges 3*b*. The seal may be for example a sealing insert of a pipe joint assembly in an oil and gas application. The advantage of the non-metallic lining 14 being a seal of this type is to allow the sensor system 1 to be quickly and easily implemented, simply by replacing the existing seal.

Figure 11:
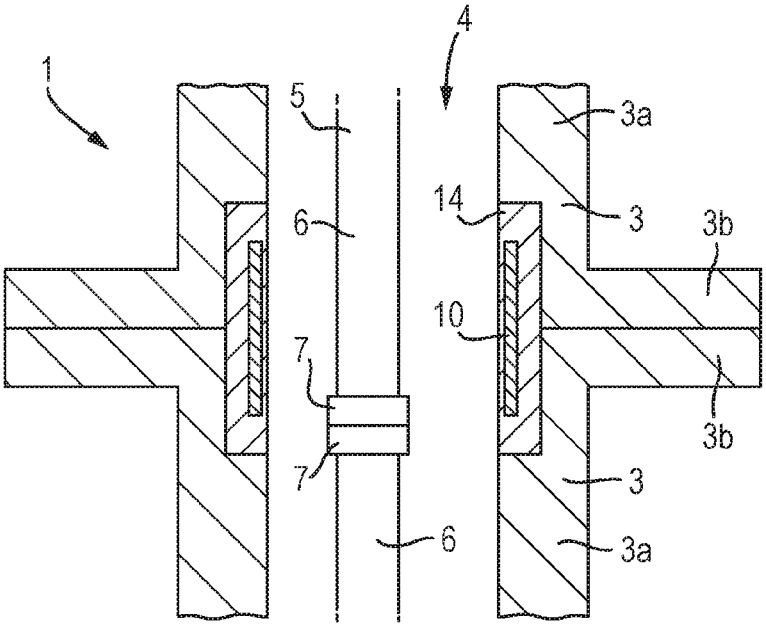
FIGS. 11 to 13 are axial cross-sectional views of alternative constructions of the sensor system.
Figure 12:
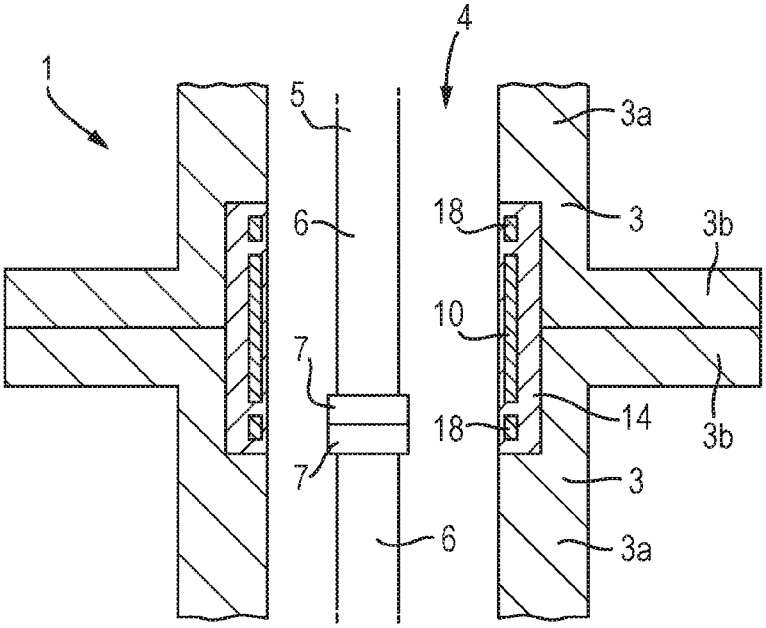
Figure 13:
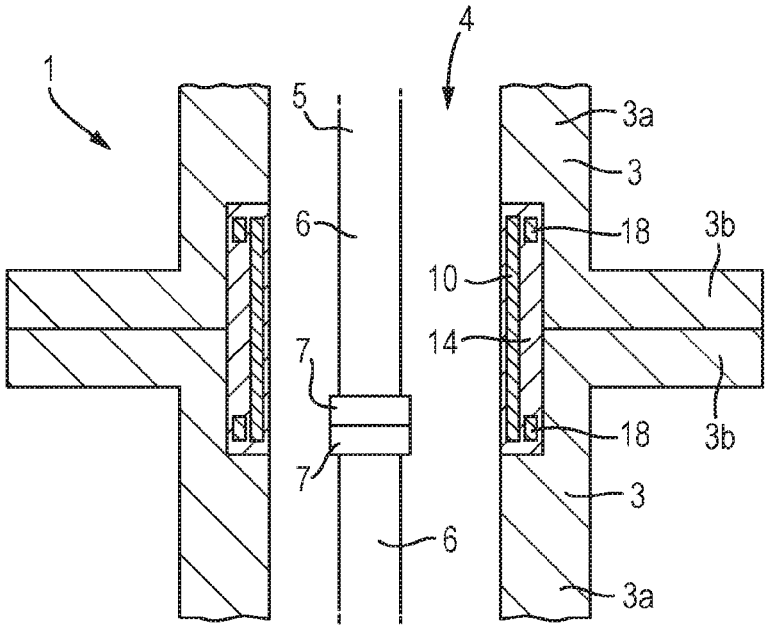

In the examples shown in FIGS. 11 to 13, the construction and materials of the coil strip 10 and the non-metallic lining 14 may be as described above and so for brevity the same reference numerals are used and the description thereof is not repeated. However, the material of the non-metallic lining 14 may be chosen to provide sufficient sealing properties, for example being made from a matrix material, composite reinforced plastic or a plastic such as PEEK.

In each of the examples shown in FIGS. 11 to 13, the sensor system 1 includes a single coil strip 10, and thus a single set of coils at different angular positions around the bore overlapping in the axial direction. This assists in packaging the sensor system 1 within an element that can replace an existing seal insert that seals across a joint between two sections of tube.

In the example shown in FIG. 11, the sensor system 1 includes only a single coil strip 10 and thus is not used to derive a measure of the axial position along the bore 4 of the joint sections 7 of the drill string 5.

However, in the examples of FIGS. 12 and 13, the sensor system 1 is modified compared to FIG. 9 by including two additional coils 18 embedded in the non-metallic lining 14 (more generally, there may be one or any plural number of additional coils 18). The additional coils 18 extend around the bore 4. As a result, the EM field generated by the coils 12 is directed along the bore 4.

In the example of FIG. 12, the additional coils 18 are disposed outside the coil strip 10. In the example of FIG. 13, the additional coils 18 are disposed behind the coil strip 10, which has the advantage of minimizing the axial extent of the sensor system 1, or alternatively maximizing the extent of the coil strip 10 to fit within a particular dimension. However, the examples of FIGS. 12 and 13 are used in the same manner as follows.

The additional coils 18 are connected to the oscillator circuit 20 and the detection circuit 22. In a similar manner to the coils 14, the oscillator circuit 20 generates electrical oscillations in the additional coil 18 for producing oscillating electromagnetic fields that interact with the contents of the bore 4, and the detection circuit detects a parameter of the electrical oscillations generated in the additional coils 18. The processing circuit 30 analyses the electrical oscillations generated in the additional coil 18 and derives therefrom a measure of the axial position along the bore 4 of the joint section 7 in the drill string 5, for example in a similar manner to that disclosed in U.S. Pat. Nos. 3,103,976 and 7,274,989. This supplements the measure of the lateral position of the joint section 7 in the drill string 5 that is derived from the coils 14.

The two additional coils 18 may be driven in unison in which case they effectively generate a common EM field, in which case the common output of both additional coils 18 is used to derive a measure of the axial position of the joint section 7 in the drill string 5. Alternatively, the two additional coils 18 may be driven independently (for example similarly to the coils 14), and a differential measure of the outputs of the additional coils 18 is used to derive a measure of the axial position of the joint section 7 in the drill string 5.

The above example relates to a sensor system 1 for sensing a drill string 5 of drill pipes 6 connected by joint sections 7 inside a bore 4 of a BOP apparatus 2. However, the sensor system 1 could be applied to sense other elongate components in a bore, typically in applications in oil and gas extraction or production. Generally the feature whose axial position is detected may be any element having a different interaction with the EM field of the coils from the remainder of elongate component. Typically, the feature will be an element having a different external shape from the remainder of elongate component.

Some non-limitative examples of alternative applications are as follows.

The bore may be a bore in any type of pipe, tube or conduit, which may or may not be applied in an oil and gas application.

The elongate component, and sensed features thereof, may be any of: a section or 'stand' of drill pipe, pipe joint, tubulars, drilling tool, tool joint, casing, casing collar, logging tool, logging tool, cabling, wireline, electric line, slickline, logging while drilling (LWD) tools or measuring while drilling (MWD) tools, cameras, debris, wrenches or spanners, jars or jarring equipment, pigs or pigging devices, production tubing, perforators or perforation equipment, coiled tubing, hosing, umbilical, composite piping or tubing, well intervention tubing, cutting tools, fishing equipment or well intervention equipment.

The sensor system can be used to locate elongate components in any vertical or horizontal infrastructure used during drilling, exploration and production of hydrocarbons including but not limited to pressure control equipment, blow out preventer (BOP), BOP stack, Christmas trees (x-trees), subsea x-trees, 'dry' x-trees, horizontal or vertical x-trees, risers, flexible risers, articulated risers, well intervention systems, well caps, containment domes, seal-subs, riser adapters, composite risers, umbilical, casing, tubing, piping, flanges, production or injection flowlines, pipelines, pipeline networks, manifolds, separators, pumps, compressors, mouseholes, moon pools, jars and fingerboards.

There are many places where there is value in detecting position of some kind of elongate component, not just in drilling but also in production, e.g. this could be manufactured or sold as an insert or module that could be coupled with or deployed on any of the above.

The invention claimed is:

1. A sensor system for sensing the contents of a bore, the sensor system comprising:

plural electromagnetic coils arranged facing the bore for generating an electromagnetic field directed laterally into the bore, wherein the coils include at least two sets of electromagnetic coils, the coils within each set being arranged at different angular positions around the bore overlapping in the axial direction, the sets of coils being separated along the axial direction of the bore;

a drive circuit arrangement arranged to generate electrical oscillations in the coils for producing oscillating electromagnetic fields that interact with the contents of the bore; and a detection circuit arrangement arranged to detect a parameter of the electrical oscillations generated in each coil.

2. A sensor system according to claim 1, further comprising a processing circuit supplied with the detected parameters and arranged to derive a measure of position of an elongate component in the bore.

3. A sensor system according to claim 2, wherein the processing circuit is arranged to derive a measure of the lateral position of the elongate component based on a comparison of the detected parameters from coils at different angular positions around the bore.

4. A sensor system according to claim 3, wherein said measure of the lateral position of the elongate component comprises at least one differential measure, in respect of a lateral axis, of the detected parameters from coils aligned with the lateral axis.

5. A sensor system according to claim 4, wherein said differential measure, in respect of a lateral axis, is normalized by the total of the detected parameters from the coils aligned with the lateral axis.

6. A sensor system according to claim 2, wherein the processing circuit is arranged to derive a measure of the axial position along the bore of a feature in the elongate component.

7. A sensor system according to claim 6, wherein the processing circuit is arranged to derive the measure of the axial position along the bore of a feature in the elongate component based on a comparison of the detected parameters from coils at different axial positions.

8. A sensor system according to claim 7, wherein the processing circuit is arranged to derive the measure of the axial position along the bore of a feature in the elongate component based on a comparison, as between at least one pair of sets of coils, of a combined measure of the detected parameters from each coil in the respective set.

9. A sensor system according to claim 8, wherein the sets of coils are separated along the axial direction of the bore by a separation that is at least the axial extent of the coils within a set.

10. A sensor system according to claim 8, wherein the coils of each set are each arranged at the same axial position along the bore.

11. A sensor system according to claim 8, wherein the coils are arranged circumferentially around the bore with equal angular spacing.

12. A sensor system according to claim 8, wherein the coils within each set are shaped to overlap in the axial direction.

13. A sensor system according to claim 8, wherein the drive circuit arrangement is arranged to generate electrical oscillations in the coils in turn within each respective set.

14. A sensor system according to claim 8, wherein said measure of the axial position along the bore of a feature in the elongate component comprises a differential measure of said combined measures of the detected parameters from each coil in the respective sets.

15. A sensor system according to claim 14, wherein said differential measure of said combined measures of the detected parameters from each coil in the respective set is normalized by the total of the combined measures from the respective sets.

16. A sensor system according to claim 8, wherein said combined measures of the detected parameters from each coil in the respective sets are sums of the detected parameters from each coil in the respective sets.

17. A sensor system according to claim 8, wherein the sensor system comprises at least three sets of electromagnetic coils, and said measure of the axial position of a feature in the elongate component is based on a comparison, as between each pair of sets of coils within the total number of sets of coils.

18. A sensor system according to claim 1, further comprising a processing circuit supplied with the detected parameters and arranged to derive a measure of the electromagnetic properties of the contents of the bore in a region adjacent each respective coil from the detected parameters from that coil.

19. A sensor system according to claim 1, wherein the elongate component comprises a drill string of drill pipes connected by joint sections.

20. A sensor system according to claim 1, wherein the drive circuit arrangement is arranged to generate electrical oscillations in each respective coil in turn.

21. A sensor system according to claim 20, wherein the drive circuit arrangement comprises a single oscillator circuit and a switch arrangement arranged to connect the oscillator circuit to each respective coil in turn for generating electrical oscillations in the coils in turn.

22. A sensor system according to claim 1, wherein each coil is identically shaped.

23. A sensor system according to claim 1, wherein the drive circuit arrangement comprises a marginal oscillator circuit.

24. A sensor system according to claim 1, wherein said parameter of the electrical oscillations generated in each coil is the frequency of the electrical oscillations.

25. A sensor system according to claim 1, wherein the electrical oscillations are radio frequency electrical oscillations.

26. A sensor system according to claim 1, wherein the coils are disposed behind a non-metallic lining of the bore.

27. A sensor system according to claim 1, wherein the coils are embedded within a non-metallic lining.

28. A sensor system according to claim 27, wherein the non-metallic lining is a insert that seals a joint between two sections of a tube forming the bore.

29. A sensor system for sensing the contents of a bore, the sensor system comprising:

plural electromagnetic coils arranged facing the bore for generating an electromagnetic field directed laterally into the bore, wherein the coils include coils at different angular positions around the bore;

at least one additional coil extending around the bore for generating an electromagnetic field directed along the bore;

a drive circuit arrangement arranged to generate electrical oscillations in the coils for producing oscillating electromagnetic fields that interact with the contents of the bore and arranged to generate electrical oscillations in the additional coil for producing oscillating electromagnetic fields that interact with the contents of the bore; and a detection circuit arrangement arranged to detect a parameter of the electrical oscillations generated in each coil and arranged to detect a parameter of the electrical oscillations generated in the additional coil.

* * * * *